US005344661A

United States Patent [19]

Mendenhall et al.

[11] Patent Number: 5,344,661

[45] Date of Patent: Sep. 6, 1994

[54] RECYCLABLE MICROWAVEABLE BAG

[75] Inventors: Abraham H. Mendenhall, Mendham, N.J.; Joseph F. Irace, Frontenac; Joseph Skudrzyk, Affton, both of Mo.

[73] Assignee: Elite Ink and Coatings, Ltd., Arthur, Ill.

[21] Appl. No.: 66,420

[22] Filed: May 25, 1993

Related U.S. Application Data

[63] Continuation-in-part of Ser. No. 714,623, Jun. 13, 1991, Pat. No. 5,223,288, which is a continuation-in-part of Ser. No. 703,280, May 20, 1991, Pat. No. 5,211,975.

[51] Int. Cl.[5] ..... B65D 81/34

[52] U.S. Cl. ..... 426/107; 219/727; 219/730; 426/234

[58] Field of Search ..... 426/107, 113, 234, 243; 219/727, 730

[56] References Cited

U.S. PATENT DOCUMENTS 4,230,924 10/1980 Brastad et al. .
4,258,086 3/1981 Beall .
4,267,420 5/1981 Brastad .
4,553,010 11/1985 Bonrer et al. .
4,555,605 11/1985 Brown et al. .
4,567,341 1/1986 Brown .
4,590,349 5/1986 Brown et al. .
4,592,914 6/1986 Kuchenbecker .
4,594,492 6/1986 Maroszek .
4,596,713 6/1986 Burdette .
4,612,431 9/1986 Brown et al. .
4,626,641 12/1986 Brown .
4,641,005 2/1987 Seiferth .
4,661,671 4/1987 Maroszek .
4,678,882 7/1987 Bohrer et al. .
4,735,513 4/1988 Watkins et al. .
4,742,203 5/1988 Brown .
4,775,771 10/1988 Pawlowski et al. .
4,780,587 10/1988 Brown .
4,794,005 12/1988 Swiontek .
4,825,025 4/1989 Seiferth .
4,861,958 8/1989 Bohrer et al. .
4,883,936 11/1989 Maynard .
4,943,456 7/1990 Pollart et al. .
4,970,358 11/1990 Brandberg et al. .
4,982,064 1/1991 Hartman et al. .
5,038,009 8/1991 Babbitt .

FOREIGN PATENT DOCUMENTS

WO8911772 11/1989 World Int. Prop. O. .
WO9107861 5/1991 World Int. Prop. O. .

*Primary Examiner*—Steven Weinstein
*Attorney, Agent, or Firm*—Paul M. Denk

[57] ABSTRACT

A microwaveable food container is provided with an accessory which contains a heat assist to facilitate heating of the food. The accessory is secured to the container along two opposite edges of the accessory and is provided with perforations which allow the metallized heat assist to be easily removed. The remaining portion of the container may therefore be recycled.

2 Claims, 1 Drawing Sheet

RECYCLABLE MICROWAVEABLE BAG

CROSS-REFERENCE TO RELATED APPLICATION

The subject matter of this application comprises a continuation-in-part of the application upon heat assist accessory for microwavable bag, filed on Jun. 13, 1991, under Ser. No. 07/714,623, now U.S. Pat. No. 5,223,288; which application is delineated as a continuation-in-part of the patent application having Ser. No. 07/703,280, filed on May 20, 1991, now U.S. Pat. No. 5,211,975 both of which applications are owned by a common assignee.

BACKGROUND OF THE INVENTION

This invention relates to microwaveable food packages, and in particular, to a microwaveable food bag which may be recycled.

Microwaveable food packages have been widely accepted and are widely used. One example of such a food package is the bag in which popcorn is sold in. The popcorn in these bags is ready for heating and need only to be placed in a microwave oven to be prepared. These packages typically employ a metallic microwave susceptor which is deposited on a portion of the container to assist in the heating of the food contained in the packages.

As can be imagined, the wide acceptance of microwaveable food packages has produced a considerable amount of waste which must be disposed. The containers are typically paper or paperboard and have the metallic heat assist applied thereto. Although the paper or paperboard portion of the container is recyclable, the metal portion is not and therefor the package cannot be recycled. To recycle the paper container the heat assist would have to be removed from the packaging. As of now, there is no known product which allows the heat assist to be easily removed.

SUMMARY OF THE INVENTION

One object of the invention is to provide a microwaveable food package which may be recycled.

Another object is to provide such a package in which the heat assist may be readily removed.

A third object is to provide such a package which will not hinder the heating of the food contained therein.

Other objects of this invention will be apparent to those skilled in the art in light of the following description and accompanying drawings.

Briefly stated, a microwaveable package of the present invention includes a container formed of a series of walls and which contains a food product. A heat assist, having a metallized heat susceptor, is applied to a wall of the bag. The heat susceptor, as is known, assists in the heating of the contents of the bag during microwave heating. The container is provided with means for separating the metallized surface from the container so that the container may be easily recycled. Preferably the container is provided with perforations around the heat susceptor which enable the susceptor to be easily removed from the container. The susceptor may also be applied to an accessory which is secured to the container along two opposite sides along two lines of attachment. The perforations here are formed in the accessory between the heat susceptor and the lines of attachment, facilitating the easy removal of the matallized susceptor from the container. The container may be provided with score lines instead of the perforations to enable quick and easy removal of the metallized susceptor.

DESCRIPTION OF THE PREFERRED EMBODIMENT

Figure 1:
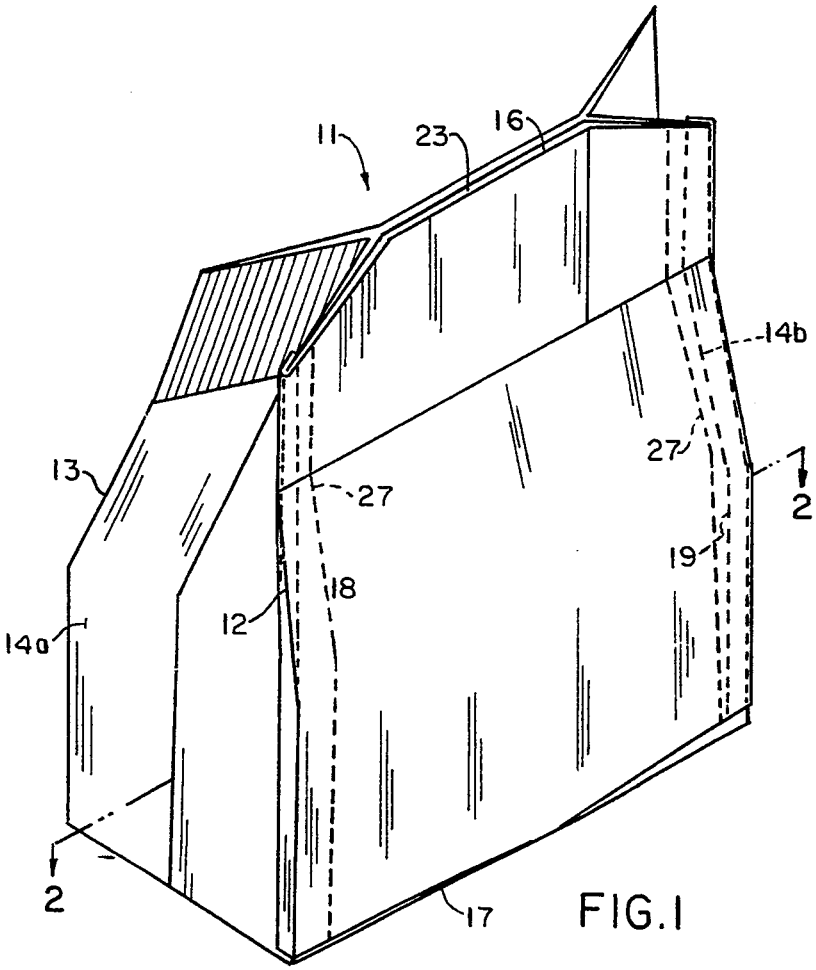
FIG. 1 is an isometric view of a container of the present invention.
Figure 2:
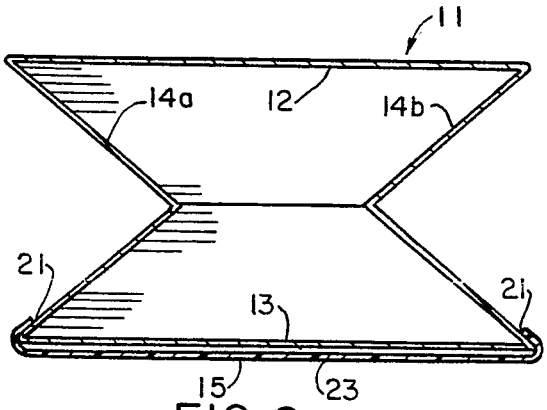
FIG. 2 is a cross-sectional view of the container taken along lines 2—2 of FIG. 1.
Figure 3:
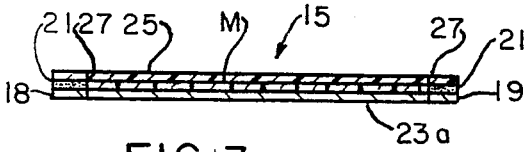
FIG. 3 is a cross-sectional view of a heat assist which is applied to the bag.

To form the microwaveable bag, a standard one-ply bag 11 having faces 12 and 13 and gusseted sides 14*a* and 14*b*, such as a standard form-and-fill preformed bag, is used. See FIGS. 1 and 2. By using a one-ply bag, the use of adhesive needed in forming two-and three-ply bags is avoided. The bag is treated with a coating, such as FC807 anti grease coating available from 3M Company, which will enable the bag to withstand the oil and grease in the food, particularly when popcorn is involved.

To obtain the desired heat assist, an accessory 15 is added to one of the faces 12 and 13 of bag 11. It is added as a form of supplemental bag or wall sleeve. Accessory 15 has a top edge 16, a bottom edge 17, and side edges 18 and 19. The accessory 15 is separated from the bag 11 except for two lines 21 of heat resistant adhesives such as Electromek WA4849 or Elite #71 available from Electromek Company, of Carlstadt, N.J. Adhesive lines 21 are formed along the side edges 18 and 19 of the accessory. The adhesive is preferably applied as a strip having a width of about 1/16" or less. Because the accessory is adhered to the bag only along two edges thereof, a gap 23 may exist between the bag 11 and the heat assist accessory 15, throughout their height. Gap 23, however, is not large enough to affect the energy which radiates from the metal layer to assist in the heating of the food product in bag 11. The metal layer normally will be located upon the inner or bag contiguous surface of the accessory 15, leaving its outer and exposed surface for other usage, such as for containing print material.

Figure 4:
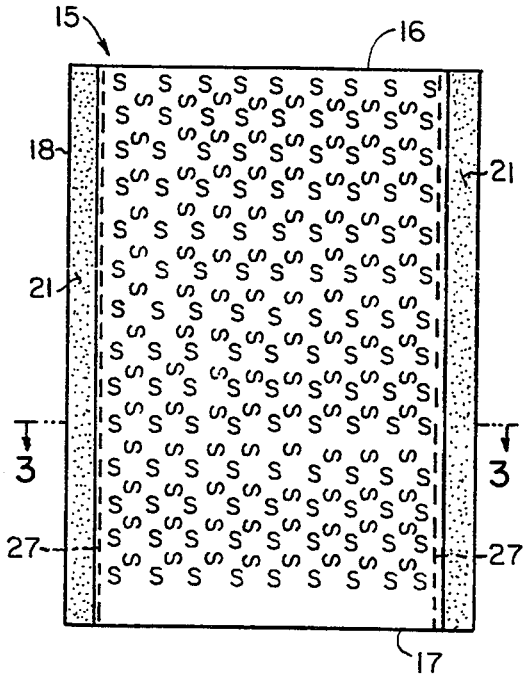
FIG. 4 is a plan view of the heat assist accessory.

The accessory is preferably made from a layer of paper 23*a* such as Rhinelander 30# MF paper having a layer of metalized M, PET film 25 laminated thereto. Film 25 is laminated to the paper layer using the same high heat resistant adhesives used to secure the accessory to the bag. The adhesive preferably is applied over the entire surface of the interface between the paper layer and the film 25. In the alternative, the adhesive may be patterned applied so that only select portions of this combination will be connected. The PET film is metalized to an optical density of about 0.22–0.28. This may comprise a layer of metal and preferably the metal surface M will be between the PET film 25 and the accessory layer of paper or the like 23*a*. The accessory is preferably fully metalized to a micron or more in thickness. Preferably, the metal is deposited in a pattern, as set forth in my co-pending application, Ser. No. 07/714,623, filed Jun. 13, 1991, and which is incorporated herein by reference. One of the preferred patterns is shown in FIG. 4.

The accessory is preferably fully coextensive with the face 12 or 13 to which it is secured. Although patterned applications may be effective. The blank from which the accessory is formed may be slightly wider than the bag face 11 so that the side edges 18 and 19 of accessory 15 can be folded around the vertical edges of the bag 11 to be adhered to the gusseted sides 14*a,b* of bag 11.

The heat assist is completely free and separate front the bag throughout its height, in the preferred embodiment. To enable the heat assist film 25 to be easily separated from the bag 11, accessory 15 is provided with perforations 27 which extend the length of accessory 15 in a space between the metalized film 25 and the glue lines 21. As can be appreciated, the perforation allows for the metalized film to be easily removed from the bag by the consumer as through tearing, after the food therein has been heated. The paper bag may then be readily recycled with other paper products.

In view of the structure of this invention, and the assembly of the container or bag 11 with the addition of the accessory of this development, the package is generally free of adhesive, except along whatever manufacturer's joint may be embodied within the structure of the bag, and for those marginal edges that apply this accessory to the container. This allows the accessory to be provided with the perforation which allows quick and easy removal of the heat assist after use. The package is free of adhesive and the heat assist is able to provide a maximum safe thermal penetration from the microwave energy without breaking up. Because it substantially completely covers the surface of the accessory, overall even heating is attained.

Numerous variations, within the scope of the appended claims, will be apparent to those skilled in the art in light of the foregoing description and accompanying drawings. For example, as previously explained, the assist accessory could be secured to the face 12 or 13 of bag 11 along the top and bottom edges of the accessory, rather than along its sides, and can also be spot tacked by adhesive along its center, but yet torn free. This would still leave the sleeved relationship, either in the form of a gap, or contiguousness, between the bag and the accessory and allow for the provision of the perforations. Further, although the preferred embodiment is shown to have perforations, score lines formed in the accessory may be substituted for the perforations. These examples are merely illustrative.

We claim:

1. A microwavable package containing a food product, said package comprising a bag formed of a series of walls including a front, back, and a bottom wall, said entire bag being formed of a single-ply paper, a heat assist accessory applied to and covering the exterior of one of said front and back wall of said bag, said accessory having a top, bottom, and side edges, said accessory being adhered to one of said front and back wall substantially only along two select opposite edges of said accessory defining lines of attachment of said accessory to said package, the remainder of said heat assist accessory being substantially unconnected with either said front or back wall of said bag, said accessory having a metallized heat susceptor surface sufficient to generate heat and provide heat assist to the contents of the package during microwaving, said accessory being devoid of said metallized heat susceptor surface in the portion of the accessory that defines said lines of attachment, said accessory comprising a single-ply paper, a polymer film having said metallized surface applied thereon and adhered to said single-ply of paper forming said accessory, and a high heat resistant adhesive securing the polymer film to the single-ply forming the accessory, such that upon microwaving of the package containing said food product, the heat resistant adhesive securing the accessory provides dimensional stability to the said film forming the accessory and preventing a delamination and break-up of the accessory and its metallized film when exposed to any microwave energy; said package further including means for separating the metallized heat assist accessory from said bag, said means for separating including either perforations or score lines in said accessory, said perforations or score lines being positioned between the respective lines of attachment and the majority of the accessory that comprises said metallized heat susceptor surface and covers the exterior of one of said front and back walls, such that after microwave heating, the major portion of said accessory can be torn away from said bag along either said perforations or tear lines leaving attached to the bag substantially only the remaining portions of the accessory that define the lines of attachment which remaining portions are devoid of metallized surface such that the paper bag can be readily recycled.

2. The package of claim 1 wherein said perforations or score lines extend substantially parallel to the lines of attachment of said heat assist accessory to one of said front and back wall.

* * * * *